United States Patent [19]

Thureson et al.

[11] Patent Number: 4,607,573

[45] Date of Patent: Aug. 26, 1986

[54] LAMINATED FUSE AND MANUFACTURING PROCESS THEREFOR

[75] Inventors: Gary R. Thureson, Avon; Ernest L. Gladden, Granby, both of Conn.

[73] Assignee: Ensign-Bickford Industries, Inc., Simsbury, Conn.

[21] Appl. No.: 596,449

[22] Filed: Apr. 3, 1984

[51] Int. Cl.[4] ..... C06C 5/04; F42B 3/10

[52] U.S. Cl. ..... 102/275.8; 102/275.5

[58] Field of Search ..... 102/275.8, 275.5, 275.1, 102/331; 86/1 R

[56] References Cited

U.S. PATENT DOCUMENTS

| | | | |
|---|---|---|---|
| 3,590,739 | 7/1971 | Persson | 102/275.5 |
| 3,730,096 | 5/1973 | Prior | 102/275.8 |
| 4,080,902 | 3/1978 | Goddard et al. | 102/275.8 X |
| 4,316,415 | 2/1982 | Baker | 102/275.8 |
| 4,328,753 | 5/1982 | Kristensen et al. | 102/275.8 X |
| 4,402,270 | 9/1983 | McCaffrey | 102/275.8 X |
| 4,493,261 | 1/1985 | Simon et al. | 102/275.8 X |

*Primary Examiner*—David H. Brown

*Attorney, Agent, or Firm*—Hayes & Reinsmith

[57] ABSTRACT

A fuse having two juxtaposed coextensive tubular housing layers is provided with a reactive material deposited within the inner tube, which inner tube is elongated or stretched before forming the outer tubular layer. In the method of manufacture, the inner tubular member is provided with a reactive material, primarily along its inner surface, thereafter stretched to provide the desired inner tube dimensions with the desired reactive material core load per unit length, the stretched tube is then provided with an outer tubular covering.

14 Claims, 4 Drawing Figures

LAMINATED FUSE AND MANUFACTURING PROCESS THEREFOR

BACKGROUND OF THE INVENTION

The present invention relates to an improved fuse for transmitting a detonation signal to a fuse device and to an improved method for producing such fuses.

The fuses of the general type to which the present invention pertain are known in the art as shown by U.S. Pat. No. 3,590,739 issued to Per-Anders Persson and assigned to Nitro Nobel AB, of Gyttorp, Sweden. The Persson patent is a pioneer invention disclosing a hollow elongated tube forming a gas channel which has a reactive substance distributed as a thin layer on the inner surface of the tube for propagating a percussion wave or detonation wave from one end of the tube to the other and describes a fuse generally formed from an extruded plastic material (such as soft polyvinyl chloride). The inner surface of the tube is coated with a suitable reactive substance including such explosives as PETN, RDX, HMX, TNT or mixtures thereof.

U.S. Pat. No. 4,328,753 issued to Leif Kristensen et al and assigned to the same assignee as the aforementioned Persson patent discloses a fuse having an inner plastic tube (formed of material such as Surlyn 1855, a registered trademark of E. I. du Pont de Nemours & Co. Incorporated) whose inner surface is coated with an explosive or suitable reactive material, the inner plastic tube being covered by an inner plastic tube intended to enhance certain mechanical characteristics of the invention while retaining the basic Persson patent concept of utilizing a plastic tube having the reactive material distributed along its length.

Such fuses have been commercially accepted and successful, finding wide usage in a variety of environments for initiating explosives, as for example, where electrical detonation is unacceptable because of environmental hazards.

OBJECTS OF THE INVENTION

It is a principle object of the present invention to provide an improved detonating fuse having a laminated tubular construction with reactive material distributed along the interior surface of a first or innermost tube, which fuse has low cost of manufacture, improved handling characteristics, improved quality control in manufacture, and other desirable advantages while retaining the essential product characteristics of the prior art.

It is a further object of this invention to provide an improved method for manufacturing such detonating fuses, which method permits higher production rates, consistent core loads of reactive material, controlled dimensions, and lower cost per unit length.

It is a still further object of this invention to provide an improved detonating fuse of the type described wherein a plurality of tubular layers are provided, the innermost layer being formed from stress oriented plastics which present the desired adhesion characteristics for the reactive material, the outer tubular layers being selected and provided in accordance with the desired physical characteristics.

It is a still further object of the invention to provide a novel manufacturing technique for a detonating fuse of the type described wherein the first tube is formed from a plastic presenting the desired adhesion characteristics for the reactive material distributed along the inner diameter of the tube, such first tube being elongated following deposition of the reactive coating thereby to provide a stretched first tube having the desired core load per unit length.

It is still another object of the present invention to provide an improved manufacturing process for a laminated detonating fuse of the type described wherein at least two co-extensive layers are provided, the innermost layer being extruded and provided with a reactive detonating material mix along the inner surface of the innermost layer prior to stretching and with the outer layer applied during or subsequent to stretching operation.

Other objects will be in part obvious and in part pointed out in more detail hereinafter.

A better understanding of the objects, advantages, features, properties and relations of the invention will be obtained from the following detailed description and accompanying drawings which set forth certain illustrative embodiments and are indicative of the various ways in which the principles of the invention are employed.

DETAILED DESCRIPTION OF THE INVENTION

Figure 1:
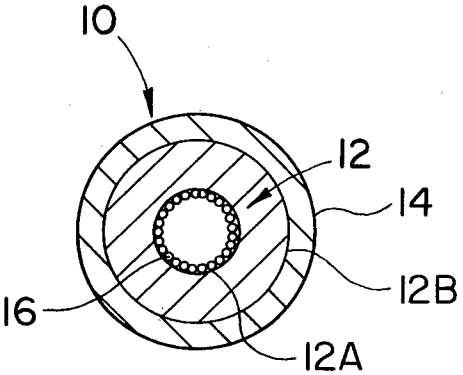
FIG. 1 PRIOR ART
FIG. 1 is a transverse cross section of a fuse known in the art.

Before proceeding with the details of a fuse formed under the method of this invention, reference to FIG. 1 illustrates a known fuse as manufactured by a conventional non-elongation process. A two layer plastic fuse 10, as described in U.S. Pat. No. 4,328,753 issued to Lief Kristensen et al and Nitro Nobel AB of Gyttorp, Sweden, is shown as having an outside diameter of about 0.118 inches or 3.00 mm formed of an inner tube 12 and outer covering 14. Inner tube 12 has inner surface 12A having a coating of reactive material 16 deposited thereon. Conventional manufacture and design of fuse 10 is such that inner tube 12 has an outside diameter of about 0.050 inches or 1.30 mm and an outside diameter of 0.118 inches or 3.00 mm with a wall thickness of about 0.034 inches. Outer covering 14 sheaths outer surface 12B of inner tube 12 to provide means for withstanding mechanical stress.

Illustrative of a single layer fuse apparatus, but not shown, is the fuse in Example 1 of U.S. Pat. No. 3,590,739 issued to Per-Anders Persson and assigned to Nitro Nobel AB of Gyttorp, Sweden which discloses a fuse having dimensions of about 0.19 inches or 5.0 mm outside diameter and 0.11 inches or 3.00 mm inside diameter.

Figure 2A:
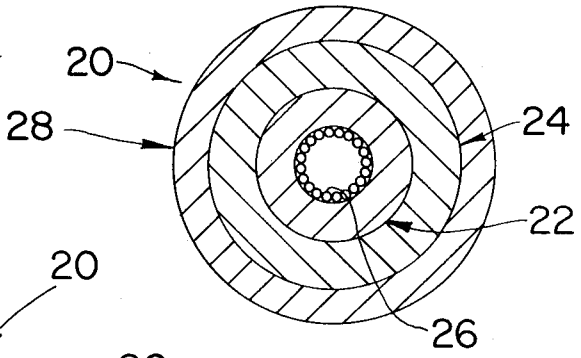
FIG. 2A is a transverse cross section of another embodiment of a fuse according to the present invention.
Figure 2:
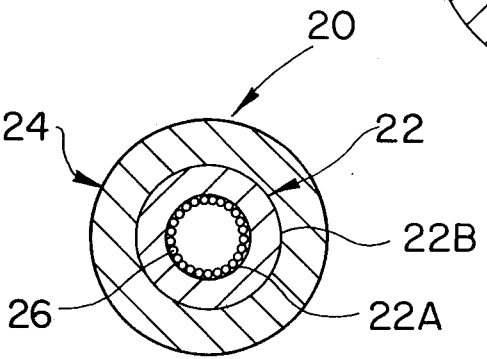
FIG. 2 is a transverse cross section of a preferred embodiment of a fuse according to the present invention.

FIG. 2 shows a fuse as manufactured by the stretch-extrusion process of this invention. A plastic first tube 22 is extruded in which the plastic material constitutes Surlyn 8940 (registered trademark of E. I. du Pont de Nemours & Co. Incorporated), EAA (ethylene/acrylic acid copolymer), EVA (ethylene vinyl acetate) or the like, such plastics having adhesive properties providing for excellent adhesion surfaces for adhering outer coating 24 to outer surface 22B of first tube 22 and reactive material 26 to inner surface 22A of first tube 22. Reactive material 26 may be comprised of a power mixture of such materials as PETN, RDX, HMX, 2, 6-bis (picrylamino)-3, 5- dinitropyridine, fuel such as powder aluminum or mixtures thereof. By providing a constant stretching or elongation force to a preformed first tube under a method to be described below, first tube 22 will have an average inner diameter in the range of 0.017 to 0.070 inches and an outer diameter in the range of 0.034 to 0.180 inches. An outer layer or coating is applied to outer surface 22B of first tube to improve ability of fuse 20 to withstand external damage and mechanical stress. Suitable materials for the outer coating 24 are poly-olefins, including but not limited to linear low density polyethylene (LLDPE), linear medium density polyethylene (LMDPE), low density polyethylene (LDPE), blends of LLDPE with ionomer, polypropylene, polybutylene, nylon, blends of nylon with coextrudible adhesives.

Figure 3:
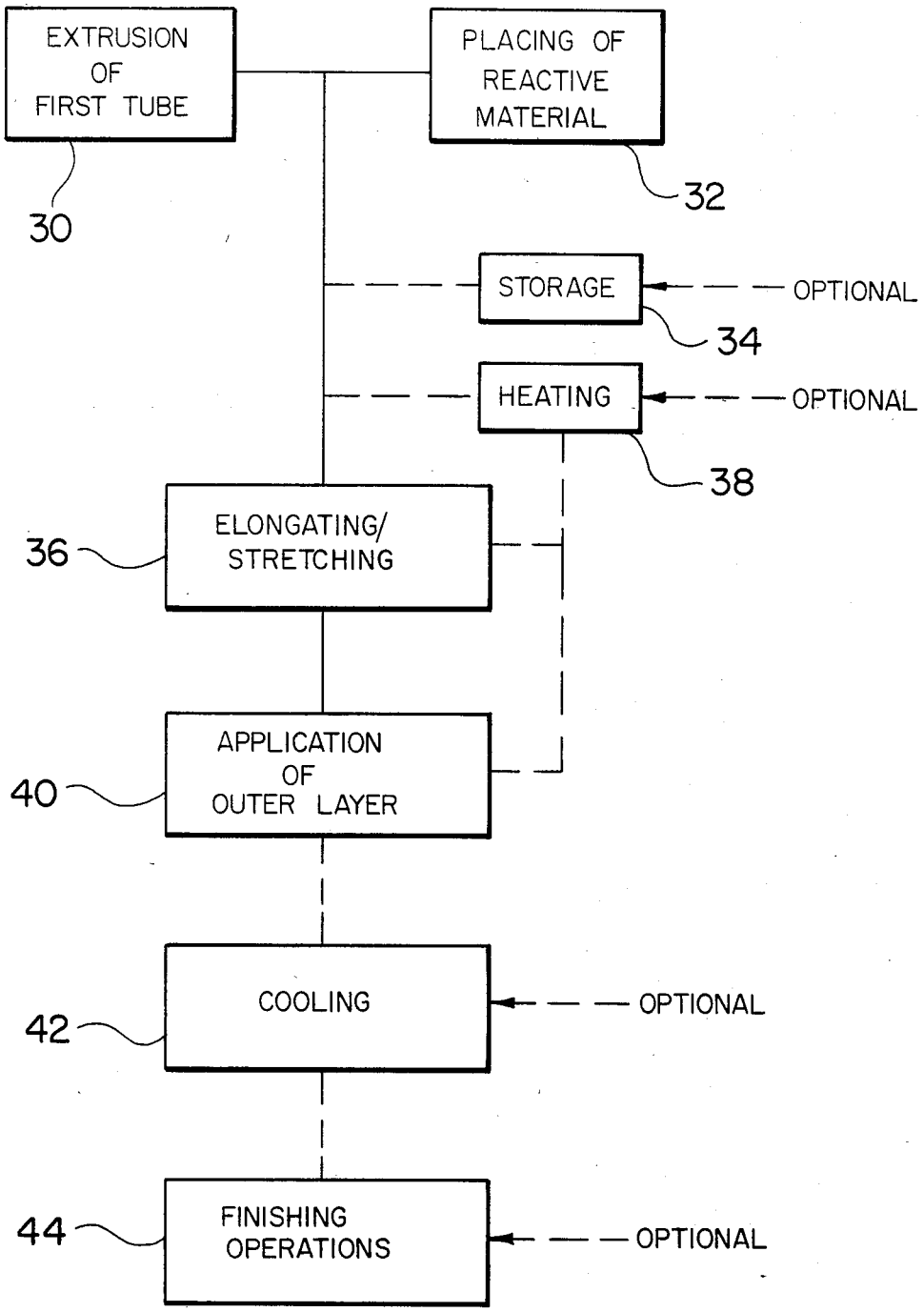
FIG. 3 is a flow diagram illustrating typical process steps involved in the method of manufacture for the present invention.

Referring now to the flow diagram of FIG. 3, there is illustrated in a general manner the steps involved in the formation of the present invention with reference to the numerals of FIG. 2 for clarification. Generally, the fuse 20 is formed in a dual operation process wherein a first or innermost tube 22 is initially manufactured in a thermoplastic extrusion operation; thereafter subjected to a stretch-extrusion operation wherein first tube 22 is stretched or elongated and provided with an outer layer or coating 24. First tube 22 is extruded, as indicated by numeral 30, having inside and outside diameters greater than what they will be in the final fuse, so that it may be efficiently manufactured, handled safely and stored (as indicated by numeral 34), as by winding first tube 22 onto process spools. A coating of reactive material 26 is deposited or applied onto inner surface of first tube 22 as indicated by numeral 32 preferably during the extrusion step 30, in a first specific core load per unit length to obtain a corresponding final core load per unit length in the fuse 20 after the stretch-extrusion step is applied to first tube 22.

First tube 22 may also be used in a continuous operation, wherein first tube 22 is formed and immediately used in the stretch-extrusion step of the process. With either operation, the first tube 22 forms the feed tube or input tube for subsequent operations.

To provide a fuse which has lower cost of manufacture, improved handling characteristics and improved quality control during manufacture while also retaining the essential product characteristics of the fuse art, first tube 22 is subjected to an elongating or stretching process to reduce the reactive material core load per unit length and first tube wall thickness while ensuring consistent core loads of reactive material or inner surface of first tube to propagate a signal. The elongation step, as indicated by numeral 36, is accomplished by applying tension to first tube 22 above the critical tensile strength of first tube material thereby longitudinally orienting the first tube materials and generating increased tensile strength. Although various types of elongation may be employed, it is preferred in accordance with the present invention to elongate the first tube 22 by providing a pair of capstans; a take-up capstan being set and controlled at a higher speed than a pay-off capstan. The end result of the difference in speed of the capstans is a stretched first tube having reduced wall thickness and a reduced reactive material core load which is capable of initiation and propagation. The ratio of the take-up capstan speed to the pay-off capstan speed determines the stretch ratio with stretch ratios ranging from about 1.1:1 and 10.0:1, and preference for ratios between 1.5:1 and 5.0:1. The stretch ratio is determined for each first tube 22 based upon physical properties and specific economic considerations of the materials used in the formation of first tube 22. Thus, the dimensions of initial, unstretched first tube 22 and the core load of the reactive materials are determined and a stretch ratio is chosen to obtain the best balance between the cost of materials and the desired physical and performance properties of fuse.

The elongation step may be enhanced by heating the first tube 22 above the softening point of the material used to form the first tube 22, as indicated by the numeral 38. Stretching will occur principally in the softened area of the first tube 22. An infra red oven, heating tunnel, natural gas flame or other suitable heating device may be used to soften the first tube. However, care is taken so that the applied heat is maintained below the activation level of the reactive material in order to prevent premature activation of the fuse.

To improve mechanical properties such as toughness, flexibility, tensile strength, heat resistance and the like, following the elongation step 36, the first tube 22 is provided with a suitable outer layer or coating, as indicated by the numeral 40, which provides the necessary resistance to external damage and mechanical stress. The outer coating 24 is preferably a coating of plastic or the like as described above. Such coatings of plastic can be easily applied by extrusion techniques but coating may also be sprayed, brushed or applied by other coating processes onto the first tube 22. A vacuum or reduced pressure chamber may be used to draw outer coating 24 tightly down around the first tube 22 providing for improved adhesion between the inner surface of outer coating 24 and outer surface of first tube 22.

The fuse 20 produced by this process may have more than one coating or layer. A multi-layer plastic fuse (FIG. 2A) can be manufactured by either subsequent stretching operations, extrusion operations, tandem extrusion or coextrusion of several coverings simultaneously. Any one or all of the intermediate or outer coating materials may be colored by the addition of a suitable thermoplastic color concentrate at the extrusion step or by the use of a precolored compound resin.

Certain two layer fuse may be elongated further to form a three layer fuse for use in special applications. Such three-layer fuses (including first tube 22, coating 24 and outermost coating shown at 28 in in FIG. 2A) are formed by applying the heating step 38, elongating step 36 and outer layer coating application step 40 to a two layer fuse.

As indicated by the numeral 42, the fuse 20 may at this stage of the process be allowed to cool to set the final dimensions. Cooling may take place by the use of mechanical devices such as a cooling troughs, spray guns or may be air cooled to room temperature.

The laminated fuse may then pass through several finishing operations, as indicated by the numeral 44. Generally, quality control or inspection functions are performed to ensure that the reactive material core load concentration falls within the desired range and above the critical core load for the reactive material used. The examining process may be effectuated in accordance with standard fuse making techniques. Additionally, the fuse diameter may be measured by appropriate devices known in the art to ensure the formation of a uniform outer layer and diameter.

Thus it is seen that utilization of the stretching process produces significant manufacturing advantages and improved physical properties in a fuse. The stretching process enables manufacture of a first tube and fuse at high process rates that withstand spooling and handling without the aid of special equipment or precautions which would be required if the first tube was initially manufactured to its final dimensions. At the reduced dimensions, the first tube would be very delicate and subject to flattening and uncontrolled elongation thereby creating undesirable dimensional changes during the necessary handling and spooling operations prior to extrusion process. The addition of the covering or coating compensates for weaknesses in the first tube created through the stretching process and results in a stronger fuse structure which facilitates handling during the stretch extrusion operation.

The following examples illustrate the present invention.

EXAMPLE 1

A two layer fuse was manufactured by the stretch extrusion process.

The first tube was extruded from an ionomer resin, in particular Surlyn Grade #8940 (registered trademark of the E. I. duPont de Nemours & Co. Incorporated). A reactive powder consisting of a mixture of cyclotetramethylene tetranitramine and flaked aluminum powder was coated onto inner surface of first tube during extrusion. The core load averaged 32 milligrams per meter.

The first tube was then put through the stretch-extrusion process described above (FIG. 3). The ratio of the capstans was controlled providing a 2:1 stretch ratio. The jacket material applied was linear low density polyethylene (LLDPE), in particular, Union Carbide grade G7341. The resultant fuse dimensions were 0.150 inch outside diameter and 0.051 inch inside diameter with an average core load of 16 milligrams per meter. The tensile strength and percent elongation measurements were 42 pounds and 600 percent, respectively with excellent adhesion between the LLDPE and first tube.

EXAMPLE 2

A three layer fuse was manufactured by the stretch extrusion process.

The first tube used for this three layer fuse was of the same construction and dimensions as cited in Example 1. It was inspected for core load uniformity and dimensional conformance before stretching.

The first tube was then coated or jacketed by the stretch extrusion process described in FIG. 3. The capstan speeds were controlled providing a 1.43:1 stretch ratio. The covering material used was Plexar #2466 (a registered trademark of the Chemplex Co.), a polyolefin based adhesive resin manufactured by the Chemplex Company designed to maximize adhesion between the layers.

This two layer tube was put through the stretch-extrusion process again with the outer most coating material (third layer) being Nylon 11. Again, the capstan speeds were controlled providing a 1.62:1 stretch ratio. This created a 3 layer fuse with nominal dimensions of 0.118 inch O.D. and 0.040 inch I.D., yielded by a final average core load of about 10.50 milligrams per meter, an overall stretch ratio of 3.05 to 1. This product had a tensile strength measurement of 52 pounds and an elongation measurement of 220 percent.

EXAMPLE 3

A two layer fuse was manufactured by the stretch extrusion process. The first tube used was of the same construction and dimensions as cited in Example 1. It was covered with Union Carbide LLDPE G7341 by the stretch-extrusion process cited in the process description and FIG. 3 at a stretch ratio of 3:1. The final fuse dimensions were 0.118 inch O.D. and 0.041 inch I.D. with a core load of 11 milligrams per meter.

As will be apparent to persons skilled in the art, various modifications, adaptations and variations of the foregoing specific disclosure can be made without departing from the teachings of this invention.

We claim:

1. A method of producing a fuse comprising the steps of:

(a) forming a first tube having an inner surface and an outer surface;

(b) placing a reactive material in a core load per unit length within said first tube;

(c) elongating said first tube whereby the wall thickness of said first tube and core load per unit length of said reactive material are reduced; and (d) applying an outer coating onto said outer surface of said first tube, said coating arranged coextensively to said elongating first tube.

2. The method of claim 1 wherein said step of placing said reactive material includes applying a coating of said reactive material in a core load per unit length of said first tube onto said inner surface of said first tube.

3. The method of claim 2 further comprising the step of heating to soften said first tube whereby said step of elongating occurs principally within the softened area of said first tube.

4. The method of claim 3 wherein said step of applying an outer coating on said outer surface of said first tube includes applying said outer coating under a vacuum for a period of time and at temperature sufficient to draw said outer coating onto said outer surface of said first tube thereby increasing adhesion between said outer surface of said first tube and said outer coating.

5. The method of claim 4 wherein said step of applying said outer coating occurs by thermally extruding said outer coating around said outer surface of said first tube.

6. The method of claim 2 or 5 further comprising the steps of:

(e) applying heat to said two-layer fuse; and (f) elongating said two-layer fuse whereby the wall thickness of both said first tube and said outer layer are reduced and said reactive material core load per unit length is reduced.

7. The method of claim 6 further comprising the step of:

(g) applying an outermost coating coextending around said outer coating of elongated two-layer fuse thereby forming a multi-layer fuse.

8. A fuse for propagating a percussion wave formed by a method comprising the steps of:

(a) forming a first tube having an inner surface and an outer surface;

(b) placing a reactive material in a core load per unit length within said first tube;

(c) elongating said first tube whereby the wall thickness of said first tube and core load per unit length of said reactive material are reduced; and (d) applying an outer coating onto said outer surface of said first tube, said coating arranged coextensively to said elongated first tube.

9. The fuse of claim 8 wherein said step of placing said reactive material includes applying a coating of said reactive material in a core load per unit length of said first tube onto said inner surface of said first tube.

10. The fuse of claim 9 further formed by the method comprising the step of heating to soften said first tube whereby said step of elongating occurs principally within the softened area of said first tube.

11. The fuse formed under the method of claim 10 wherein said step of applying an outer coating on said outer surface of said first tube includes applying said outer coating under a vacuum for a period of time and at temperature sufficient to draw said outer coating onto said outer surface of said first tube thereby increasing adhesion between said outer surface of said first tube and said outer surface.

12. The fuse formed under the method of claim 11 wherein said step of applying said outer coating occurs by thermally extruding said outer coating around said outer surface of said first tube.

13. The fuse formed under the method of claim 12 further comprising the steps of:

(e) applying heat to said two-layer fuse; and (f) elongating said two-layer fuse whereby the wall thickness of both said first tube and said outer layer are reduced and said reactive material core load per unit length is reduced.

14. The fuse formed under the method of claim 13 further comprising the step of:

(g) applying an outermost coating coextending around said outer coating of elongated two-layer fuse thereby forming a multi-layer fuse.

* * * * *

UNITED STATES PATENT AND TRADEMARK OFFICE

CERTIFICATE OF CORRECTION

PATENT NO. : 4,607,573

DATED : August 26, 1986

INVENTOR(S) : Gary R. Thureson and Ernest L. Gladden

It is certified that error appears in the above—identified patent and that said Letters Patent is hereby corrected as shown below:

Column 1, line 14, after the word "which" insert --tube--.

Column 2, line 51, wherein the words "outside diameter" should be --inside diameter--.

Column 2, line 64, after the word "fuse" insert --20--.

Column 3, line 6, wherein the word "power mixture" should be --powder mixture--.

Column 3, line 57, wherein the word "or inner surface" should be --on inner surface--.

Signed and Sealed this

Tenth Day of February, 1987

*Attest:*

DONALD J. QUIGG

*Attesting Officer*

*Commissioner of Patents and Trademarks*